United States Patent [19]

Nicolaus

[11] 4,411,428

[45] Oct. 25, 1983

[54] REPOSITIONING MECHANISM FOR GAME REELS

[75] Inventor: Frank G. Nicolaus, Chicago, Ill.

[73] Assignee: Bally Manufacturing Corporation, Chicago, Ill.

[21] Appl. No.: 891,310

[22] Filed: Mar. 29, 1978

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E, 138 A; 235/1 C; 74/128, 437, 435, 409, 411, 461

[56] References Cited

U.S. PATENT DOCUMENTS

| | | | |
|---|---|---|---|
| 782,628 | 2/1905 | Taylor | 74/461 X |
| 1,809,995 | 6/1931 | Unverdross | 74/435 UX |
| 2,093,813 | 9/1937 | Macourek | 273/143 R |
| 2,530,996 | 11/1950 | Russell | 273/143 R X |
| 2,579,241 | 12/1951 | Nicolaus | 273/138 A X |
| 2,945,624 | 7/1960 | Nicolaus | 235/1 C X |
| 3,034,790 | 5/1962 | Breitenstein | 273/138 A X |
| 3,704,890 | 12/1972 | Zucker et al. | 273/143 R |
| 3,733,075 | 5/1973 | Hooker et al. | 273/143 R X |

FOREIGN PATENT DOCUMENTS

| | | | |
|---|---|---|---|
| 1292712 | 10/1972 | United Kingdom | 273/143 R |
| 1348309 | 3/1974 | United Kingdom | 273/143 R |

*Primary Examiner*—Robert A. Hafer
*Assistant Examiner*—Arnold W. Kramer
*Attorney, Agent, or Firm*—Callard Livingston

[57] ABSTRACT

Mechanism for repositioning one of a set of symbol-displaying spinning reels in game apparatus to change the symbol display. A reel-stepping gear with yieldable jambproof overload-responsive driving components changes the position of the reel by coaction with an associated code disc to step the reel in either direction once per duty cycle of the gear and change the position of the reel by an angular amount equal to the spacing of the symbols thereon, while also releasing the existing reel-indexing mechanism so the reel is free to move and then re-indexing the reel in its new position once in each duty cycle. Free-wheeling of the released reel is prevented during the repositioning operation by an automatic brake. Any number of duty cycles may be initiated to change the position of the reel a corresponding number of steps in a given game cycle.

10 Claims, 6 Drawing Figures

10
12
10A
10A
13
14
11
18
16
19
17
14
14
62x
64x
21
AWARD RELAY
30
22
17
57
31
32
36
15
54
34
55
54
35
56
46
52
49
50
51
48
52
45
41
40
44
42

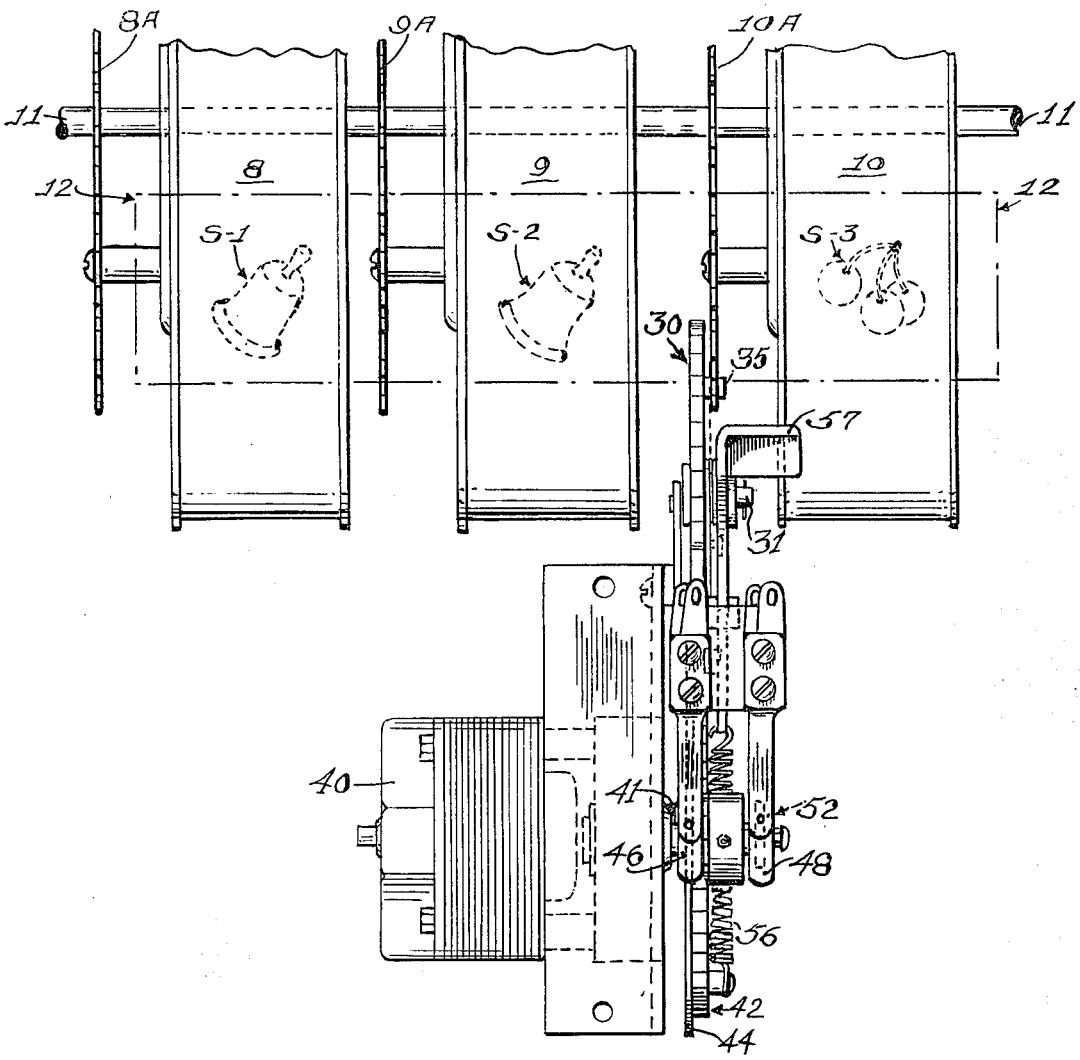
Fig. 2.
Fig. 3.
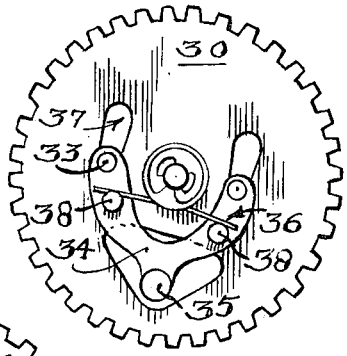
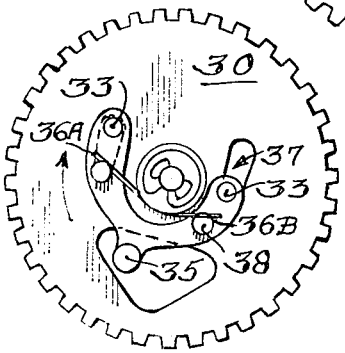
Fig. 3A.
Fig. 4.
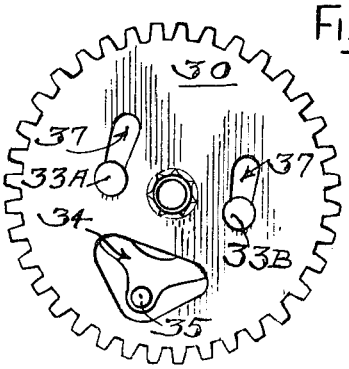

REPOSITIONING MECHANISM FOR GAME REELS

The invention provides a reel-repositioning mechanism operative in game apparatus of the spinning-reel type, such as fruit, poker, and slot machines, wherein several symbol-bearing reels are set rotating and caused to come to rest in various random display positions in which the symbols may or may not represent a high-score or prize award combination.

Such machines commonly have a group of three to five rotatable reels which will be set in motion to spin freely at the beginning of each game cycle and then caused to stop in sequence in various randomly-indexed display positions with the frequent result that the displayed array of symbols form part, but not all, of a symbol combination needed to produce a high-score winning or award condition, with the possibility nevertheless that movement of one reel a single step in one direction or the other might change the display to a winning combination.

Arrangements have been proposed heretofore to effect adjusting movement of the reels or symbol patterns in such circumstances in various types of game mechanims, as for example in British Pat. Nos. 1,292,712 and 1,348,309, or in U.S. Pat. No. 3,733,075, the latter disclosing an involved solenoid-actuated ratchet means for effecting reel movement, whereas the first-mentioned British patents disclose only diagrammatic arrangements for modifying the symbol pattern or display.

In accordance with the invention, a compact, accurate, and jam-free reel-repositioning unit is provided for cooperation with a type of reel mechanism such as shown in U.S. Pat. No. 2,579,241, in which each reel is equipped with a companion code disc having radial code slots of varying value-determining depth engaged by a combination indexing and decoding pawl serving both to stop the reel in display position and to set the score value of the displayed symbol by determining the corresponding position of an associated score value switch dependently upon the depth of the code slot engaged.

In accordance with additional features of the invention, the repositioning unit includes a reel-stepping gear rotatable in duty cycle affording one symbol change for each duty cycle of the gear which includes a driving element projecting from a reversely-yieldable yoke carrier mounted on the gear and travelled once per duty cycle of the gear in a trajectory to engage the code disc transiently and change its position to display one or the other of the two symbols which flank the symbol initially displayed, and at the same time to withdraw the indexing pawl prior to and during the repositioning operation and then restore the pawl to the newly-indexed position as the result of accurate duty-cycle control of a reverse-driving motor means by cycling the homing switch means.

More detailed aspects of novelty and utility characterizing the invention will appear from the following description of a preferred embodiment thereof taken in view of the annexed drawings, in which:

FIG. 2 is a front view of parts of the apparatus shown in FIG. 1;

FIG. 3 is a plan detail of the front side of the stepping gear;

Figure 5:
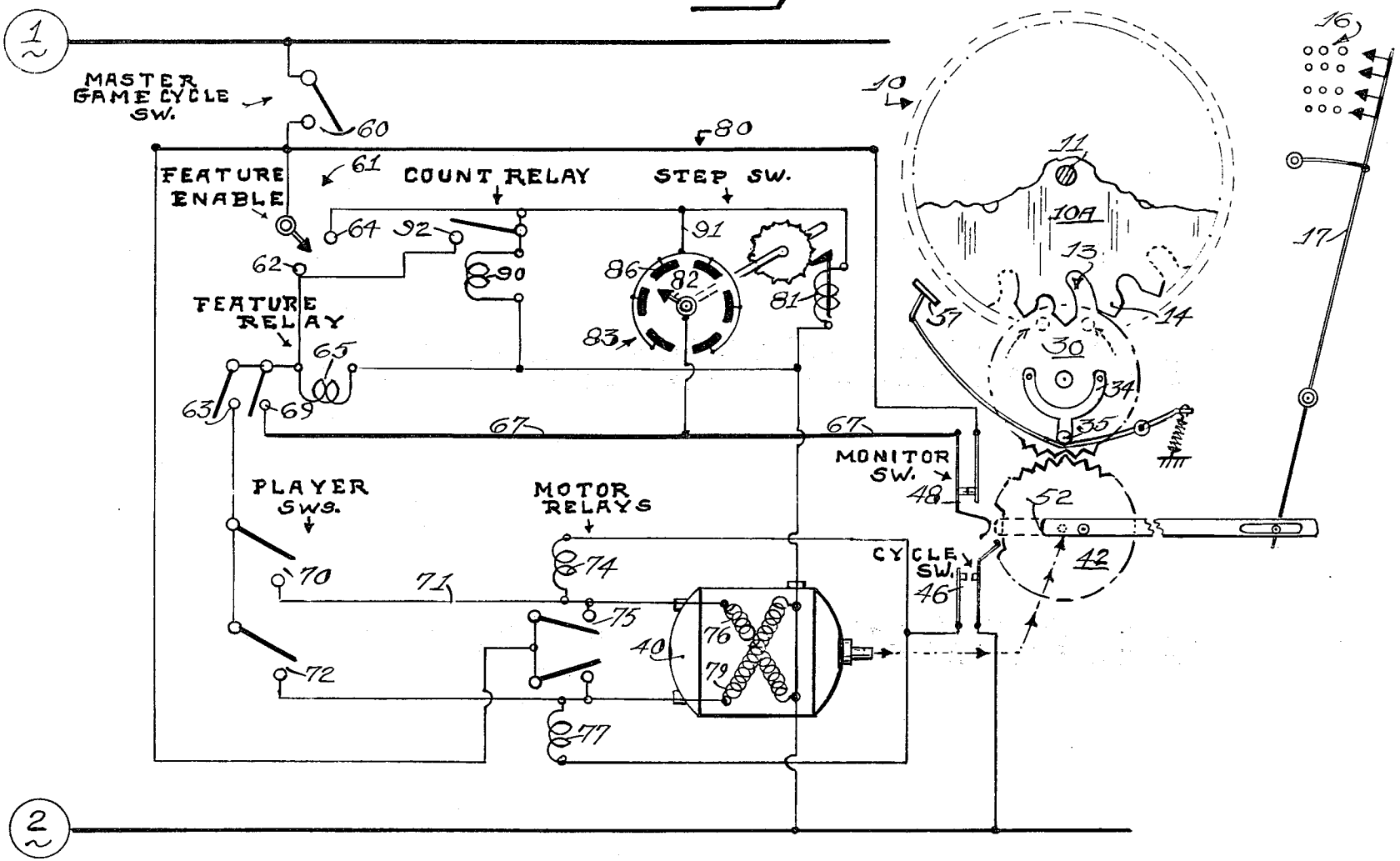

FIG. 3-A is a change-position view of the stepping gear of FIG. 3;

FIG. 4 shows the obverse side of the stepping gear;

FIG. 5 is a schematic operating and circuit diagram.

Figure 1:
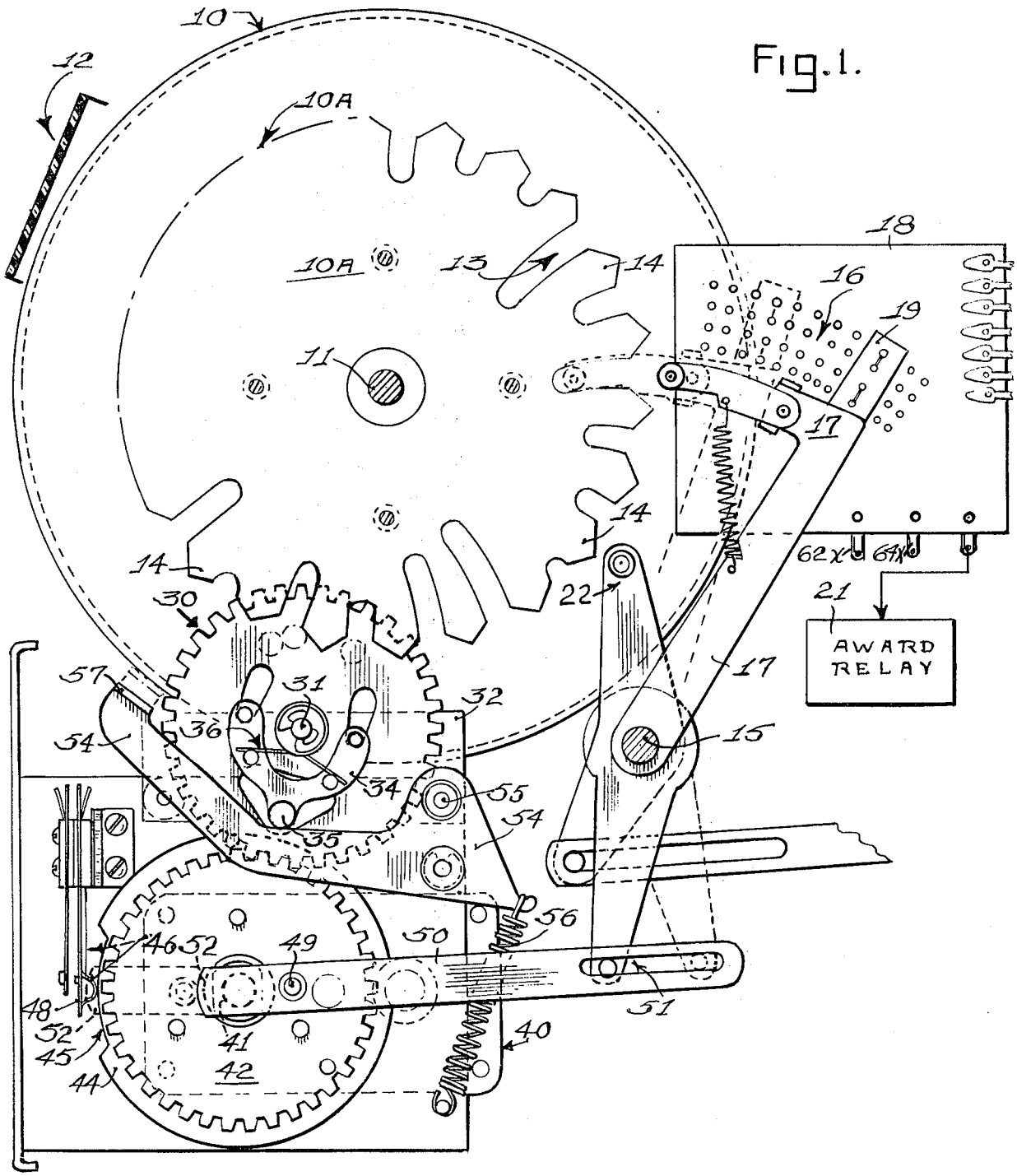
FIG. 1 is a side elevation of the reel-repositioning mechanism in cooperative relation to parts of a code disc, reel and award switch mechanism.

Referring to FIG. 2, a set of three reels 8, 9, and 10, and their attached code discs 8A, 9A, and 10A, rotate about a common spindle 11, and when standing indexed position will display various combinations of symbols such as S-1, S-2, and S-3, in horizontal alignment across the machine before a viewing window 12 indicated in FIG. 1, the latter view showing the code disc 10A of the last reel assembly and the radial code notches or slots 13 therein and intervening toothed formations 14 about the periphery thereof, it being understood that each symbol on the face of a reel will relate positionally to some corresponding code notch in alignment therewith on the appertaining code disc.

As viewed in FIG. 1, each reel assembly, comprising the reel and its code disc, has associated therewith a combination indexing and code readout pawl 17 pivotable on a shaft 15 to enter any of the code slots and thereby position a corresponding value switch wiper contact 19 on some set of contacts in the array of value contacts 16 on the corresponding panel 18, such that when all reels have been indexed near the end of the game cycle, the several wiper contacts 19 may in known manner set up a chain circuit through all contact panels to determine a winning combination for the displayed symbols, with resultant operation of further circuit means enabling a so-called feature circuit, affording further playing features or privileges, or possibly actuate an award relay 21.

The known construction and operation of the reel machine is such that at the beginning of the playing cycle, spinning pawls 22 associated with each reel will be rapidly thrust into and abruptly withdrawn from any confronting tooth 14 in a triggered action which will flip the appertaining code disc and its reel into a free spin, all of the reels starting together, the respective indexing pawls 17 thereafter being caused by timing means (not shown) to be moved slowly toward their code discs and sequentially triggered in a random fashion to enter some code slot and stop the reel with concurrent positioning of the appertaining readout wiper contact 19 on the field of value contacts on panel 18, to determine the award, if any.

Assuming, with reference to FIG. 2, that such a game cycle has been completed and that the set of reels has been indexed into a display condition in which the symbols, such as S-1, S-2, S-3, appear before the display window 12 with the evident result that two of the symbols are identical, while the third is different, so that if three-of-a kind arbitrarily represents a winning or award combination, the player may wish to adjust the position of the last reel 10, provided this feature or option is available at the moment, as the result, for example, of enablement of the repositioning means under control of master circuit means provided in the reel machine.

Commonly only the last reel of a set will be adjustable, and only one step or symbol change will ordinarily be permitted in any game cycle, the repositioning feature being preferably made available at indeterminate intervals under control of random-operating switch means, or the like, as will more fully appear.

As depicted in FIG 1, the repositioning mechanism comprises a stepping gear 30 rotatable on stub shaft 31 fixed on the unit chassis plate 32, and has shiftably supported on its side a carrier yoke 34 on which is affixed a disc-driving element or stud 35 normally positioned in radial alignment with the gear axis and travelled by rotation of the gear along a trajectory which will cause the stud to impinge in passing upon one of the code slot formations 14 in each duty cycle of the stepping gear, with resultant displacement of the disc and reel assembly the angular distance between the centers of the symbols, whereby to shift the reel to display one or the other of the two symbols which flank whatever symbol is on display at the time the duty cycle is initiated.

The stepping gear 30 can be driven reversely through one revolution, arbitrarily constituting one duty cycle, by a reverse-driving motor means 40 having a built-in reduction gearing driving an output shaft 41 on which is affixed a driving gear 42 meshing with the stepping gear and having affixed on its side a switch-actuating disc 44 including a cam notch 45 actuating a normally-open cycling switch 46 (FIG. 2) to be connected in a cycling circuit such that when a starting or enabling pulse is applied to the motor, the cycling switch 46 will close and hold a running circuit for the motor for the required one-revolution or equivalent duty cycle of the stepping gear 30 in conjunction with other supervisory action of a Monitoring or homing switch 48 operative in each duty cycle to signal that the player has availed himself of the optional feature and to disable the Player-Selection Switch Means for the remainder of the duty cycle, the Monitor Switch being timed to be opened preferably at the half-cycle phase of each duty cycle by engagement therewith of the end 52 of a long drive arm 50 for such purposes, as will further appear.

To free the reel assembly 10, 10A for repositioning, index release and repositioning means is provided in the form of a long crank arm 50 pivotally connecting at 49 to the driving gear 42 and having a variable-range or lost-motion pin-and-slot connection 51 with the indexing pawl such that when the pawl is in the full-line indexing position it can be oscillated by the reel machine mechanism without interference from the crank arm, but at the start of each repositioning duty cycle the crank arm will pull the pawl free of the code disc so that the reel can be shifted by the stepping gear, to be reset at the end of the repositioning cycle in a new index position.

The drive gear 42 could be omitted and the crank connected directly to the stepping gear, however such an arrangement would crowd the mechanism and supervisory switch means 46, 48, and cause functional and assembly difficulties.

The several reel assemblies are journalled on anti-friction bearings and dynamically balanced for maximal free-spinning rotation, and therefore have a sensitive tendency to react and turn slightly responsive to withdrawal of the indexing pawl, and free-wheeling of the adjustable reel 10 is prevented to assure accurate repositioning by automatic operation of a damping or restraining means comprising a brake arm 54 pivoted at 55 on the chassis plate and urged toward the reel by spring means 56, an offset tappet or pad 57 being provided at the end of the arm to bear against the rim of the reel responsive to the initial advance of the driving stud 35 in each duty cycle whereby to free the brake arm for movement by the spring and thrust the tappet against the reel with sufficient force to prevent free-wheeling, while permitting ready movement of the reel by stud 35 without loading the latter sufficiently to cause the carrier yoke 34 to yield in its intended overload reaction against the action of its centering spring means 36 which maintains the yoke and stud 35 in normal disc-engaging driving position. As the stepping gear approaches completion of its duty cycle, the stud 35 in returning to home position re-engages the brake arm to pivot it into the released condition seen in FIG. 1.

As viewed in FIG. 4, the stud-carrying yoke 34 is slideably attached to the stepping gear by means of flat slide rivets 33 at the end of each yoke arm respectively slideable in corresponding slots 37 in the gear plate, the yoke being centered by action of spring arms 36A, 36B bearing against pins 38 on the yoke to occupy the normally-centered driving position of the latter seen in FIGS. 1 and 3.

FIG. 4 shows the obverse side of the stepping gear and the headed sides 33A of the yoke slide rivets.

Due to possible malfunction in the reel mechanism, damage can arise from application of repositioning forces on the code discs, as by the stepping gear, at a time when the disc is locked in the index position for any reason, or is in motion as an incident to spinning action, or as the result of an attempt to shift the reel when it is properly restrained by special holding means present in some game machines as a special feature affording the option of holding one or more reels through a spinning cycle. For such reasons, the repositioning means provides an overload yield ability in the stepping mechanism, preferably in the special form of the spring-centering of the stud-carrying yoke means 34, 35, 36, in consequence of which the yoke can yield in either direction from its normally-centered condition seen in FIGS. 3 and 4, to one of the two opposite relief positions, as shown in FIG. 3-A, wherein the yoke is shown shifted in the direction of the arrow as would be the result in the case of excessive resistance to the driving action of the stepping gear stud and, for example, if the reel were locked in indexed condition for any reason, as by failure of the index pawl to withdraw, in which case the stepping gear could continue to revolve through any number of duty cycles without damage.

Since the free-spinning action of the reels in assuming their primary display and read-out positions operate on a chance basis, and the scoring odds are rather accurately calculable for each type of machine and playing pattern, it becomes essential in permitting player participation and control in modifying the primary reel display to control the optional changes in reel position without severely upsetting the basic odds characteristic of any particular reel machine; and an object achieved by the invention is the provision of a relatively simple and dependable mechanism for repositioning a reel incrementally in either direction a controlled or predictable number of times per game cycle, and to provide circuit means operative, as will be described in view of FIG. 5, for utilization of the capabilities of that mechanism.

Operation of the illustrative embodiment of the device, as depicted diagrammatically in FIG. 5, is intended to permit repositioning of a reel from time to time in various game cycles as a special bonus feature which will be made available preferably on an unpredictable or random basis, for which purposes any suitable enabling means may be employed to render the option available to the player during one or another game cycle after the spinning phase is concluded and the reels have been indexed in their primary display condition, as in FIG. 2. If at such time the feature has become available by the actuation of a random or other type of enabling control, a signal lamp (not shown) will be illuminated to indicate to the player the availability of the feature and whether one or several repositioning steps will be permitted.

The game cycle when initiated by the player will effect closure of power supply contacts 60 of a Master Game Cycling and Control Means governing operation of the machine as a whole, and if it is assumed that the random operation of the Feature Enabling Means 61 provides an enabling pulse at the single-step mode contact 62, the Feature Relay 65 will operate and hold itself in via monitor conductor 67 and holding contact 69, whereby to maintain the relay operated until the player actuates one or the other of the selectable reel-repositioning switches 70 ad 72 now temporarily enabled for cycling the motor at contact 63 of the Feature Relay.

Assuming that the player chooses to move the reel 10 forward one step by operating the Player Switch 70, a motor starting pulse will thereby be applied to conductor 71 to energize the foward winding 76 of the repositioning motor 40 in accompaniment with instant closure of the Cycle Switch 46 and concurrent operation of the corresponding Motor Relay 74 which thereupon establishes a holding circuit at its contacts 75 with resultant sustained running of the motor through one duty cycle which will be terminated by reopening of the Cycle Switch 46.

Approximately midway in the duty cycle the Monitor Switch 48 will be transiently opened and drop out the Feature Relay by interrupting power momentarily on the monitor feed conductor 67, thereby disabling the Player Switches 70 and 72 for the remainder of the game cycle.

Continuing in the single-step mode, if the player should choose instead to step the reel backward rather than forward, as was done in the previous example, he will operate the step-back Player Switch 72 and cause a similar sequence of operations to occur, but with resultant energization this time of the reverse-driving motor winding 79 and actuation of the appertaining Directional Motor Relay 77 for the duration of the step-back duty cycle the Feature Relay being dropped at mid-cycle, as before, by opening of the Monitor Switch 48. Thus, in the selectable reverse repositioning operations afforded in the single-step mode, the Feature Relay will operate once responsive to actuation of one or the other of the two directional Player Switches, which will thereafter be promptly disabled by the drop-out action of the Monitor Switch.

Considering next the multiple-step mode which can also become available under control of the Feature Enabling Means 61 if it provides an enabling pulse at contact 64, the Feature Relay 65 will be conditioned for operation more than once in conjunction with a suitable Counting Switch Means 80 including stepping type switch mesans having a stepping coil 81 and associated ratchet mechanism of known character operative to effect the step-by-step advance of moveable wiper contact means 82 responsive to pulsing of the coil, the wiper contact normally being disposed in open-circuit or zero position in relation to a corresponding set of contact segments 83 engageable thereby on taking the first step off zero, and being disengaged from each contact segment after taking some predetermined number of control steps, two in this instance.

In the arrangement of FIG. 5, an enabling pulse at contact 64 will be applied to the coil of a Count Relay 90 ad also the stepping coil 81 via conductor 91, causing this relay to pull in and stepping the wiper 82 to first position on the two-step segment 86, thus applying power from the Monitor Conductor 67 via the wiper and conductor 91 to hold the stepping coil energized and hold in the Count Relay 90, causing the latter to energize the Feature Relay 65 at its contacts 92, this condition now being held for two steps of the stepping switch to permit two operations of the Player Switches 70, 72, to initiate two repositioning cycles of the Motor.

Assuming initiation of the first such duty cycle by operation of one or the other of the manual switches 70 or 72, the opening of the Monitor Switch 48 as an incident to the first cycle will deenergize both the counting stepper coil and the Count Relay 90 and drop out the Feature Relay 65, permitting the known wiper-ratchet means to complete its first step in readiness for the second, such that when the Monitor Switch 48 recloses the process will be repeated with energization of the Count Relay 90, the stepping coil 81 and the Feature Relay 65, as before; and when the Monitor Switch 48 once again opens in the second and last permitted duty cycle, the stepping wiper will be caused to leave the contact segment and stand again in an open-circuit starting position in consequence of which no further repositioning operations can be had without initiating a wholly new game cycle, it being evident nevertheless that the counting segment contacts 83 can be of an extent to permit many more than two steps if desired.

The master cycling control circuitry will cause opening of the Master Switch 60 at the conclusion of the described game cycle and also terminate any game cycle by operation of known timing means in the event a player walks away from the machine without exercising any of the usual feature options which would otherwise be required to terminate the game.

It will be understood that the repositioning apparatus can be enabled by pulses supplied by means other than the random source described, for example enabling signals may be applied at contacts 62 and 64 from the described code disc read-out means 16, 17, as the result of some predetermined score or symbol evaluation sensed in the field of contacts 16 by the decoding contactor means 17, and providing enabling signals at terminals 62X and 64X, FIG. 5.

The illustrative embodiment of the device shown in FIG. 1 depicts components of an actual reel machine wherein the drive ratios of the gears 30 and 42 relative to each other and the diameter of the code disc 10A, with regard also for the number and angular spacing of the code configurations thereon, represent parameters which in such embodiment effect an angular shift in repositioning the code disc and reel the distance necessary to change the display by only one reel symbol, and the duty cycles each equate uniformly for a change of one symbol responsive to one complete revolution of the stepping gear 30 of substantially 360° of rotation, with tolerance of two or three degrees or so allowing for switch operation by the switch cam means 44–45.

It will be understood that different sizes of code disc with optionally different patterns of code slots and reels with varying numbers of symbols are to be expected in different models of reel machine and will require appropriate adjustment of the effective gear ratios of the driving and stepping gears accordingly.

The expression "duty cycle" as employed herein to include the appended claims, will accordingly be understood to mean that amount of rotation of the stepping gear system which will produce the requisite angular repositioning of the code disc and its appertaining symbol reel to change the reel display by substantially the same angular shift in each duty cycle of the stepping gear means requisite to effect the requisite movement of the particular code disc employed in each instance, whether the number of symbols in each repositioning exchange equate to a change of only one or several symbols in such duty cycle.

I claim:

1. Reel-repositioning mechanism for use in spinning reel games having a symbol-bearing reel with co-rotatable code disc means and indexing means acting on the disc means to stop the reel in display positions, said mechanism comprising: a stepping gear; motor means operative to rotate said gear; control circuit means operative to initiate and terminate duty cycle operation of said motor means to turn said stepping gear through a uniform angular distance constituting a duty cycle; disc-drive means rotatable with said gear in driving juxtaposition with said disc means to exert a repositioning force on the disc means by transient engagement therewith in each said duty cycle whereby to step the reel the angular distance necessary to change the symbol which was on display prior to initiation of such duty cycle to display an adjacent symbol.

2. Mechanism according to claim 1 further including means yieldingly interconnecting said disc-drive means with the stepping gear for rotation therewith as aforesaid and further operative to yield and permit continuing rotation of the stepping gear in the event the disc means presents more than a predetermined resistance to said repositioning force.

3. Mechanism according to claim 2 further characterized by the inclusion of brake means cooperative with said motor means to act in each duty cycle to restrain free-wheeling movement of the reel and disc means while free of the influence of the indexing means as aforesaid, but permitting movement of the reel and disc means responsive to application of said repositioning force provided the reel and disc means are not subject to any restraining force other than that of said brake means.

4. Apparatus according to claim 1 wherein the reel game is provided with indexing means including an indexing pawl movable to and from indexing engagement with said code disc means to hold the same in various indexed reel-display positions, and the repositioning mechanism further includes index control means cooperative with said indexing pawl and actuated by power transmitted from said motor means in each said duty cycle thereof to actuate the index pawl in a way to free the code disc means of all influence of the pawl in opposition to repositioning movement while said repositioning force is acting.

5. Apparatus operative in predetermined duty cycles for repositioning a symbol-bearing reel in reel-spinning game machines wherein the reels are rotated in game cycles and have associated for rotation therewith a code disc or the like having code formations about its axis of rotation each aligned angularly with a corresponding reel symbol, together with indexing means cooperative in each game cycle with the code disc to index the same and the appertaining reel in a primary display position, said apparatus comprising, namely: a rotatable repositioning member juxtaposed with the rotational path of said code formations for transient engagement with one of said formations once in each duty cycle of said rotatable repositioning member whereby to displace the disc and appertaining reel by an angular amount equivalent to one symbol-displaying position and thereby replace the symbol displayed by another; selectively reversible motor means operative in each duty cycle to effect rotation of said rotatable repositioning member through its said duty cycle whereby to effect one symbol change per cycle in either direction from the primary display position of the reel as aforesaid; and control circuit means including player-operable selection switch means and means rendering the same operative selectively during the game cycle to effect running of said motor means through one duty cycle in one or the other direction with corresponding directional rotation of said rotatable repositioning member whereby to reposition the reel by one symbol in either a forward or backward sense from its primary display position.

6. Apparatus according to claim 5 further including index-actuating means cooperative with the motor means and said indexing means to activate the latter and effect a reindexing of the reel in its repositioned condition as an incident to each duty cycle.

7. Reel-repositioning mechanism operative to adjust symbol display in reel-spinning games wherein a symbol-bearing reel to be adjusted has in rotational association therewith a code disc including code formations, each corresponding to a symbol display position, and indexing means operative to index the reel and code disc in various symbol-display positions, characterized in that: the reel is moved one symbol step once in each duty cycle of a stepping gear disposed in juxtaposition with the code disc and angular path of said code formations, said stepping gear including a drive member rotated through a path to engage one of said code formations once per duty cycle of the gear whereby the displace the disc and associated reel a distance bringing another symbol into viewing position; together with motor means driving said stepping gear in such duty cycles; crank means having a lost-motion driving connection with the indexing means and operative in each duty cycle to neutralize the indexing means during repositioning movement of the reel and disc and reindex the reel and code disc in adjusted position by the conclusion of each repositioning operation; and switch means operative by the repositioning mechanism in each duty cycle for connection in a power circuit for the motor to run the latter for the duration of the duty cycle reponsive to application of an initial starting pulse to the motor means, and a control circuit operative to initiate and terminate said duty cylces of the motor means.

8. In a reel game apparatus, symbol-bearing reels rotated and indexed into primary symbol-display condition in game cycles, and repositioning mechanism for changing the position of a reel to be adjusted to display a different symbol from that displayed in the primary condition, said mechanism comprising gear means and means mounting the same in driving relation to said adjusted reel; motor means operative to rotate the gear means in duty cycles of uniform angular extent; a yieldable driving means travelling with the gear means and operative in each duty cycle of the rotated gear means to effect an incremental movement of the adjusted reel relative to its primary display condition to display a different symbol in a step by step manner, together with control circuit means operative to start and stop the motor means to effect rotation of the gear means in duty cycles as aforesaid each effecting one symbol change by incremental movement of the adjusted reel as aforesaid.

9. Apparatus according to claim 8 further characterized in that said control circuit means includes connection with said motor means and a source of operating power; and enabling switch means having single-step and multiple-step modes; feature relay switch means; step-counting switch means; selectively operable player switch means; cycle switch means actuated by the motor means to connect power supplied to the motor means for the duration of each initiated duty cycle; and monitor switch means actuated by the motor means at a time between initiation and termination of each duty cycle, the several switch means aforesaid being connected to function cooperatively for initiation and termination of duty-cycle operation of the motor and gear means responsive to each operation of said enabling switch means in either mode, such that operation of any player switch means in either mode applies starting power to the motor means; the cycle switch means governs sustained running of the motor means and terminates each duty cycle thereof; the feature switch means operates in each duty cycle to enable the player switch means for application of a starting pulse to the motor means as aforesaid in either mode; and the monitor switch means disables the player switch means after initial starting of the motor duty cycle as aforesaid, followed also in the single-step mode by disablement of the feature switch means, whereby to terminate the single duty-cycle mode, while in the multiple-step mode the count relay switch means and step switch means cooperate to reoperate said feature switch means a predetermined number of times permitting a corresponding number of repositioning operations by the player switch means in response to a single operation of said enabling switch means in the multiple step mode.

10. Code readjusting means in game apparatus of the type wherein code members are rotated in game cycles and brought to rest by index means stopping and holding the same in various index positions on a chance basis to take up index positions which are variably determinative of award and non-award conditions, together with means for readjusting the position of at least one of the code members following the indexing thereof in a game cycle in expectation of changing the initially indexed code combination, characterized in that the code members have circumferentially arranged code configurations each corresponding to a code index value and position subject to repositioning from indexed position by angular shift of the code member to another index position for the purpose aforesaid by action of a juxtaposed stepping member having a code-member drive means yieldably engageable with any juxtaposed code configuration on such member so that turning of the repositioning member in predetermined duty cycles each of approximately the same angular extent, will change the angular position of the appertaining code member from its indexed position as the result of such duty cycle; motor means and drive means actuated thereby responsive to energization of said motor means to turn said stepping member in duty cycles in repositioning action as aforesaid; control circuit means including switch means operative under control of said drive means and connected to initiate and terminate complete duty cycles of the motor means and associated drive means as aforesaid responsive to a repositioning signal applied to said control circuit means; and index control means having impositive driving connection with said index means and actuated by said drive means in each said duty cycle at the commencement thereof to free the code member of influence of said indexing means for the duration of repositioning movement thereof.

* * * * *